US005248106A

United States Patent [19]

Biagiotti

[11] Patent Number: 5,248,106

[45] Date of Patent: Sep. 28, 1993

[54] REWINDER WITH MEANS FOR CHANGING THE NUMBER OF PERFORATIONS PROVIDED AROUND EACH LOG IN THE COURSE OF FORMATION

[75] Inventor: Guglielmo Biagiotti, Lucca, Italy

[73] Assignee: Fabio Perini S.p.A., Lucca, Italy

[21] Appl. No.: 689,558

[22] Filed: Apr. 23, 1991

[30] Foreign Application Priority Data

Apr. 27, 1990 [IT] Italy ..... 9374 A/90

[51] Int. Cl.[5] ..... B65H 19/26; B65H 18/20

[52] U.S. Cl. ..... 242/56 R; 242/66; 242/56.8

[58] Field of Search ..... 242/56 R, 56.6, 56.8, 242/66

[56] References Cited

U.S. PATENT DOCUMENTS 4,487,377 12/1984 Perini ..... 242/56.8

4,687,153 8/1987 McNeil ..... 242/56.8

*Primary Examiner*—John M. Jillions

*Attorney, Agent, or Firm*—Francis J. Bouda

[57] ABSTRACT

A rewinder for producing rolls or logs (R) of web material (N) comprises at least a roller (5, 7, 8) rotating at a speed proportional to the feeding speed of the web material (N), members (10, 11, 13) defining a winding space for the formation of the log (R), a pusher (15) for introducing a core into the winding space, and a cutting device (10, 21, 23, 25) for cutting the web material (N) at the end of the winding of each individual log (R). The rewinder. further comprises a mechanism (41, 61) for automatically varying the phase of the motion of the cutting device (10, 21, 23, 25) with respect to the motion of the web material (N).

18 Claims, 16 Drawing Sheets

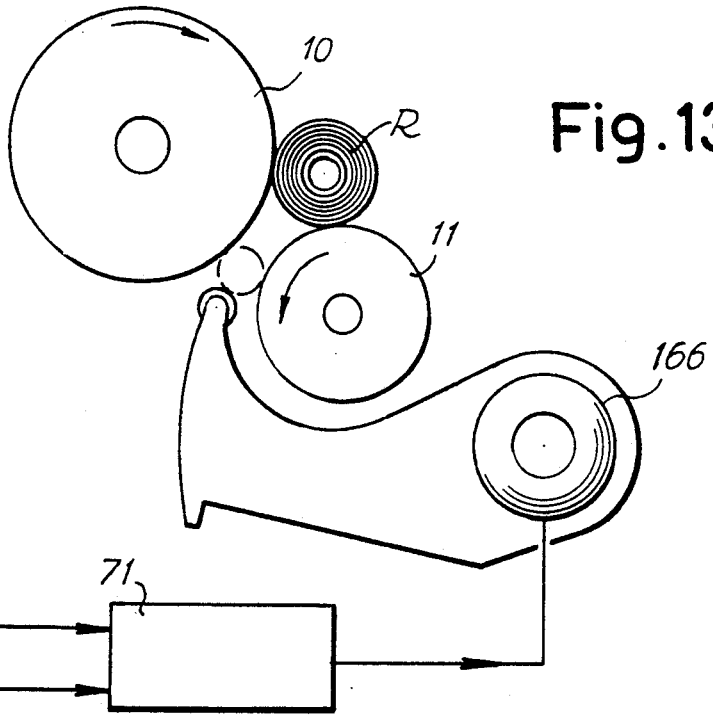
Fig. 13B
Fig. 13A
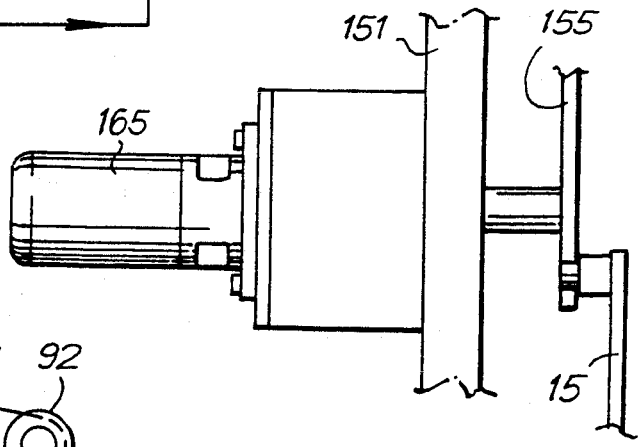
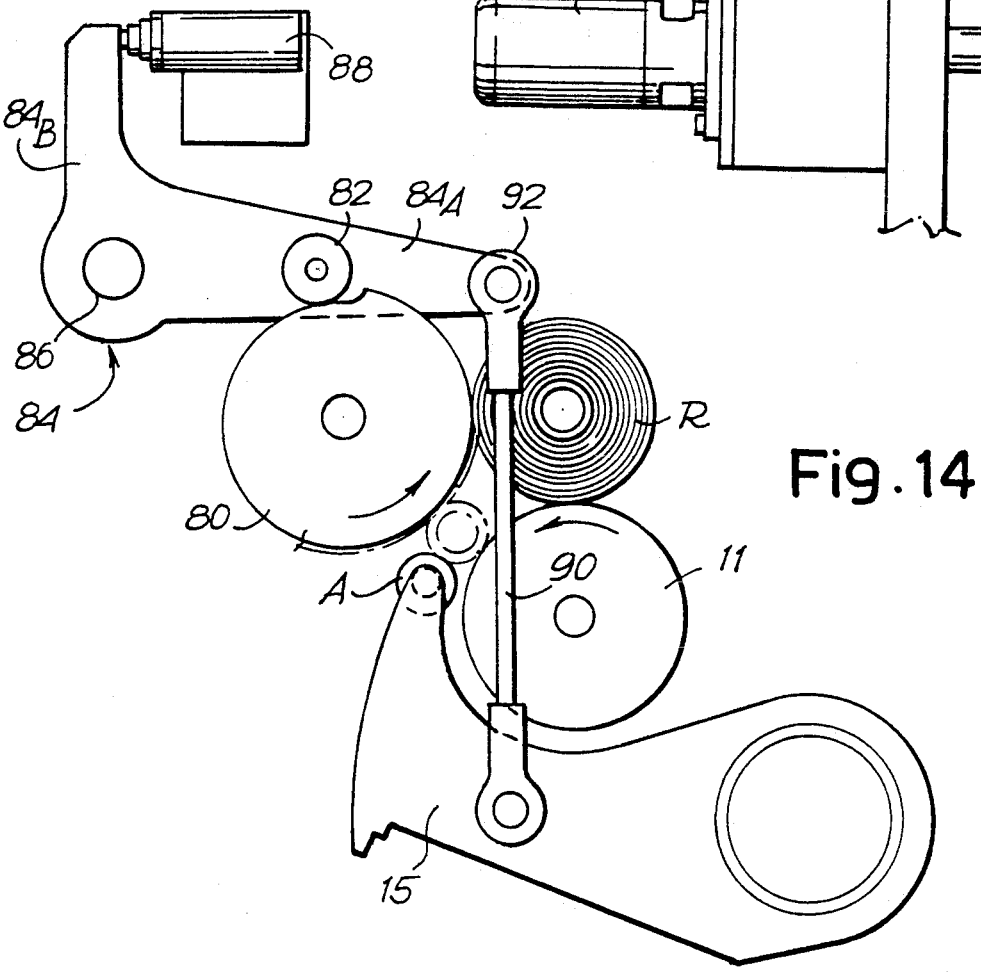
Fig. 14

REWINDER WITH MEANS FOR CHANGING THE NUMBER OF PERFORATIONS PROVIDED AROUND EACH LOG IN THE COURSE OF FORMATION

SUMMARY OF THE INVENTION

The invention relates to a rewinder for the formation of rolls of logs of web material which are intended for the production of small rolls of, for example, toilet paper, all-purpose wiper or the like.

More particularly, the invention relates to a rewinder of the type comprising at least a roller rotating at a speed proportional to the feeding speed of the web material, means defining a winding space for the formation of the log, pusher means for introducing a core into said winding space, and cutting means for cutting the web material at the end of the winding of each individual log.

A rewinder of this type is known, for example, from the Italian patent application No. 9502 A/81 and from U.S. Pat. No. 4,487,377. In this rewinder, a pair of perforator rollers is provided which carry out a series of transverse perforations over the web being wound. Located downstream from said perforator rollers is a cylinder or drum which defines, together with a lower winding roller, a nip wherein the cores are inserted, one at a time, and on which the web is to be wound for the formation of a log. The drum, along with the lower winding roller and with an upper roller for the control of the diameter of the log in the course of formation, defines a winding space wherein the roll or log of wound web is formed. Associated with the drum is a cutting cylinder carrying a blade which cooperates with an individual counter-blade on the drum in order to cut the web at the end of the winding of a log.

To carry out the cutting of the web, the cutting cylinder is made to oscillate periodically towards the drum thereby bringing the blade of said cylinder into cooperation with the counter-blade of the drum. The oscillatory motion takes place according to a program preset by a cam system after a pre-determined number of perforations, has been wound onto the log in the course of formation. In this rewinder, the motions of the drum and of the cutting cylinder, as well as the motion of the perforator rollers and of the winding means, are made strictly dependent on each other, so that the number of perforations present on the web being wound on each individual core is equal to a multiple of the number of perforations present over a web length which corresponds to the length of the drum circumference. This is due to the fact that the cutting of the web can take place only when the counter-blade provided on the drum is at a position corresponding to the blade of the cutting cylinder.

The number of perforations in the wound log depends on the number of revolutions performed by the drum between two successive oscillations of the cutting cylinder. Accordingly, the variation of the number of perforations on a fully-wound log may take place only and exclusively according to multiples of the number of perforations which are present along the circumference of the drum. The above limitation is to be found also when the machine has no perforator rollers. In this case, in fact, the length of the web which can be wound over an individual roll or log can be made to vary only according to a multiple of the web length corresponding to the circumference of the drum.

Besides allowing only a limited variation of the number of perforations on each individual log, a further limitation of this rewinder is that any such variation requires the stopping of the machine and the replacement of the cam members and of the relevant transmissions which operate the oscillation of the cutting cylinder.

It is, therefore, a first object of the invention to provide a rewinder of the above-mentioned type able to modify, in a continuous way and with no changes of the. mechanical members of the machine,.the number of perforations on the web wound in each log being formed, that is to say, the length of the web forming each log.

This and other objects, which will be evident to those skilled in the art by a reading of the following description, are achieved according to the invention, with a rewinder of the above-mentioned type, wherein means are further provided for automatically varying the phase of the motion of said cutting means with respect to the motion of the web material. The phase variation of the cutting means may be such as to possibly advance or delay the cut to an extent that may be up to half the circumference of the drum, thereby allowing the machine to wind-up logs having any number of perforations. The machine is also able to modify the length of the wound web material by any extent. Provision may also be made for the phase variation of the cutting means to take place in such a way as to determine only an increase, or only a decrease. In this case, the extent of phase variation may be as much as the whole circumference of the drum.

In a particular embodiment of the invention, the means for automatically varying the phase of the motion of the cutting means comprise at least an epicyclic gear train with an input axle which is kinematically connected to said at least one roller rotating at a speed proportional to the feeding speed of the web material, and a second axle kinematically connected to a phase-resetting motor, whose rotation causes a temporary variation of the rotational speed of an output axle of said epicyclic gear train, wherein said output axle operates the cutting means.

In practice, the epicyclic gear train may be a differential, an axle of which is connected to the phase-resetting motor, while the other axle is connected to the cutting means, the gear casing of the differential being kinematically connected to at least one roller rotating at a speed proportional to the feeding speed of the web material.

In a particularly simplified embodiment of the rewinder according to the invention, the axle on the take-off side of the epicyclic gear train is kinematically connected to a drum for the winding of the web material, said drum carrying at least a counter-blade for the cutting of the web material, which cooperates with a blade carried by a cutting cylinder, the motion of the cutting cylinder being synchronized with the motion of the drum. This embodiment overcomes further limitations of prior rewinders.

In the traditional rewinders, not only is the length of the web material wound on an individual log (and/or the number of perforations on said wound web) difficult to be changed, but also the distance between two subsequent individual perforation lines must be preset, and if changed the web be not cut along a perforation line.

By providing an epicyclic gear train connected to the winding and cutting drum, the motion of the latter may be put out of phase with respect to the feeding motion of the web material so as to correct the position of the cutting means even when the distance between successive perforations is modified, thereby always ensuring that the final cutting of the web material takes place along a perforation line.

In another embodiment, the output axle of the epicyclic gear train is kinematically connected to a cutting cylinder carrying a blade for cutting the web.

In other embodiments, to be described below and defined in the attached claims, provision may be made for combining (with the use of two epicyclic gear trains) the two embodiments set forth above.

The rewinder may be provided with perforator rollers for carrying out a plurality of transverse lines of perforations on the web material, and in this case the input motion of the means for automatically changing the phase of the motion of the cutting means with respect to the feeding motion of the web material, may be taken from one of said perforator rollers. However, the above described advantages, concerning the possibility of continuously and automatically varying the length of the web material being wound on the log formed by the machine, can be achieved also in the absence of perforation means.

When the rewinder is of the type comprising a winding drum and a cutting cylinder which carry the means for cutting the web, the cutting cylinder may be provided with an oscillatory motion to move it close to the winding drum and perform the cutting of the web material, or the blade carried, by the cutting cylinder may be provided with an oscillatory motion for its extraction and retraction. In this case, the oscillatory motion may be controlled by an electrical signal which is a function of the amount of web material wound on the log in the course of formation.

Advantageously, the pusher means for the insertion of the cores within the winding space may be actuated by an output axle of an epicyclic gear train whose input motion is obtained from said at least one roller rotating at a speed proportional to the feeding speed of the web material. Associated to the gear train is a corrector motor connected to one of the axles of the epicyclic gear train to temporarily vary the speed of the output axle of said epicyclic gear train. A safe and reliable variation of the frequency of operation of the core feeding means is thus obtained without changing the motion thereof during the introduction. However, other solutions may be provided to operate the core feeding means, as described below and set forth in the appended claims.

When the winding space is defined at the bottom by a lower winding roller rotating at a controlled and variable speed in order to perform the discharging of the log upon completion of the winding thereof and to control the movement of the newly inserted core through the nip between the rollers, the rotary speed of said lower winding roller, may also be controlled by an epicyclic gear train and by a corrector motor connected to one of the axles of said epicyclic gear train.

On the whole, an improved rewinder according to the invention may comprise in combination: at least a roller rotating at a speed proportional to the feeding speed of the web material; a winding drum; a cutting cylinder cooperating with said winding drum to carry out the cutting of the web material, the winding drum and the cutting cylinder carrying means for the cutting of the web material; a lower winding roller defining, along with the winding drum, a winding space for the formation of the log, said lower winding roller being controlled in such a way as to be able to slow down and control the discharge of the finished log and the advancement of the just inserted core; a pusher for introducing a core into said winding space and associated with means for modifying the frequency of operation of said pusher; means for automatically varying the phase of the motion of said cutting means with respect to the motion of the web material; sensor means for detecting the extent of phase variation of the cutting means with respect to the advancement of the web material sensor means for detecting the degree of correction of the frequency of operation of the pusher means; and a control unit for programming and controlling the extent of phase variations of the cutting means, the correction of the frequency of operation of the pusher means with respect to the web advancement, and the system for controlling the slowing down of the lower winding roller.

This rewinder may be further improved by providing a speed sensor connected to the control unit and associated to at least one roller rotating at a speed proportional to the feeding speed of the web material, whereby the phase variation of said cutting means and the correction of the rate of operation of the pusher means take place at a speed which is a function of the feeding speed of the web material.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

FIGS. 13A and 13B show diagrammatically two different apparatuses for the actuation of the core pusher.

FIG. 14 shows a schematic diagram of another type of apparatus for the actuation of the core pusher.

Figure 1:
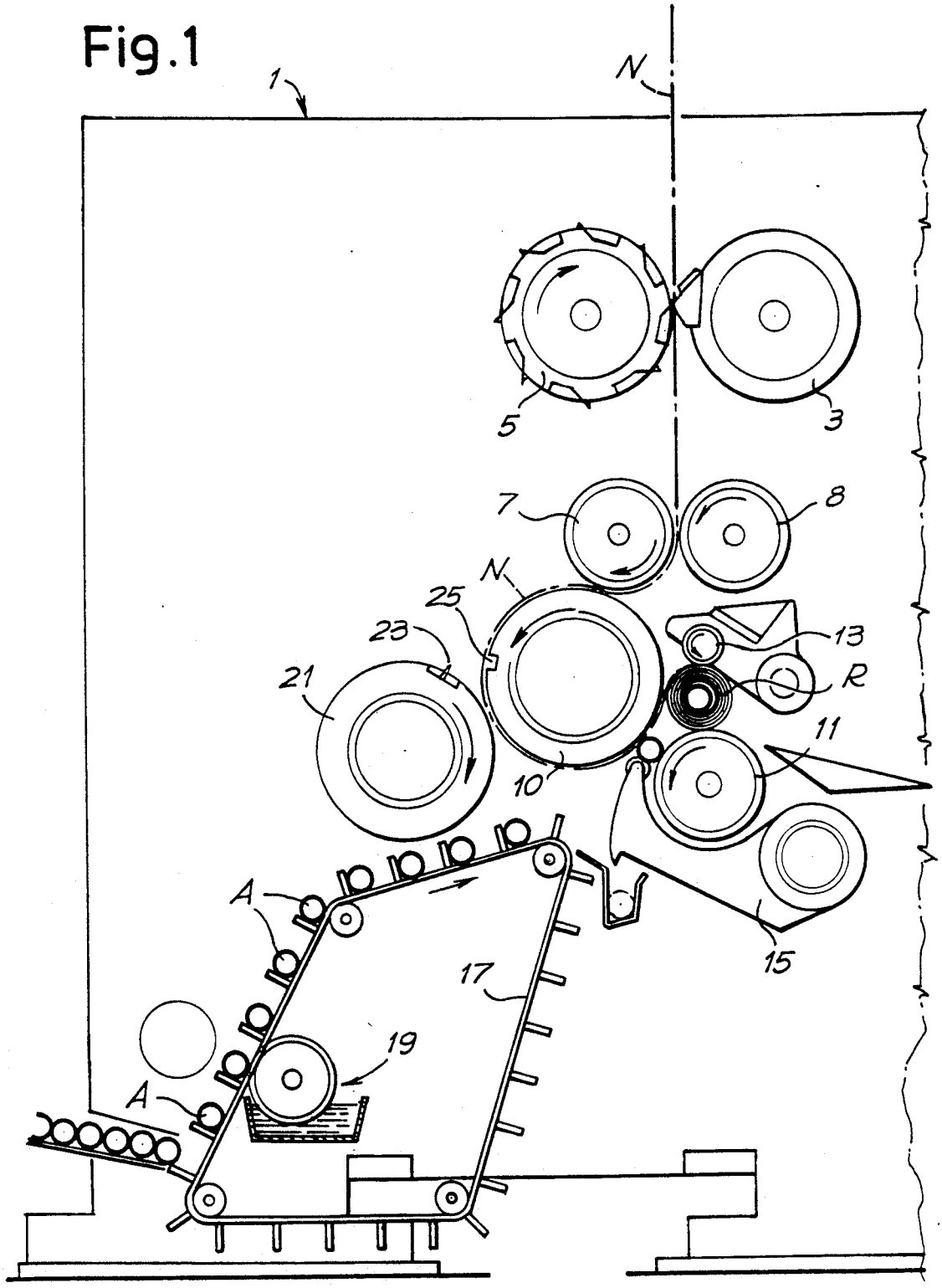
FIG. 1 shows a schematic diagram of a rewinder according to the invention.

With first reference to FIG. 1, the rewinder according to the invention, generally indicated by 1, is provided with a pair of perforator rollers 3, 5 carrying a blade and one or more counter-blades respectively to perform a series of transverse perforations on the web N, whereby said perforations define the web tear lines. Disposed downstream from the perforator rollers 3, 5 is a pair of transfer cylinders 7, 8 and a drum 10, whose construction and operation are described in the Italian patent application No. 9502 A/81 or in the corresponding U.S. Pat. No. 4,487,377, and which are incorporated herein by reference.

The web N is driven onto the drum 10 and is wound on a core to form a roll or log R in a winding space defined by the drum 10, by a lower winding roller 11 and by a diameter control roller 13. A core pusher 15 picks up the cores A from a continuous conveyor 17 for inserting them into the nip defined by the drum 10 and by the lower winding roller 11. Associated with the conveyor 17 is an apparatus generally indicated by 19 for distributing an adhesive on the surface of cores A.

Associated with the drum 10 is a cutting cylinder 21 provided with a cutting blade 23. The cutting cylinder 21 is caused to oscillate periodically to and against the drum 10 to bring the blade 23 into cooperation with a counter-blade 25 disposed on the drum 10, thereby carrying out the cutting of the web N. This takes place at the end of the winding of a log R and prior to the insertion of the new core to initiate the winding of a successive log. The rotary motion of the cutting cylinder 21 depends, in a manner to be described later, on the rotary motion of the drum 10 so as to maintain the motion in phase and thus ensuring that the blade 23 of the cutting cylinder 21 cooperates always correctly with the counter-blade 25 of the drum 10.

The apparatus described above is also shown in the Italian patent application No. 9502 A/81 and the U.S. Pat. No. 4,487,377 mentioned above.

Figure 2:
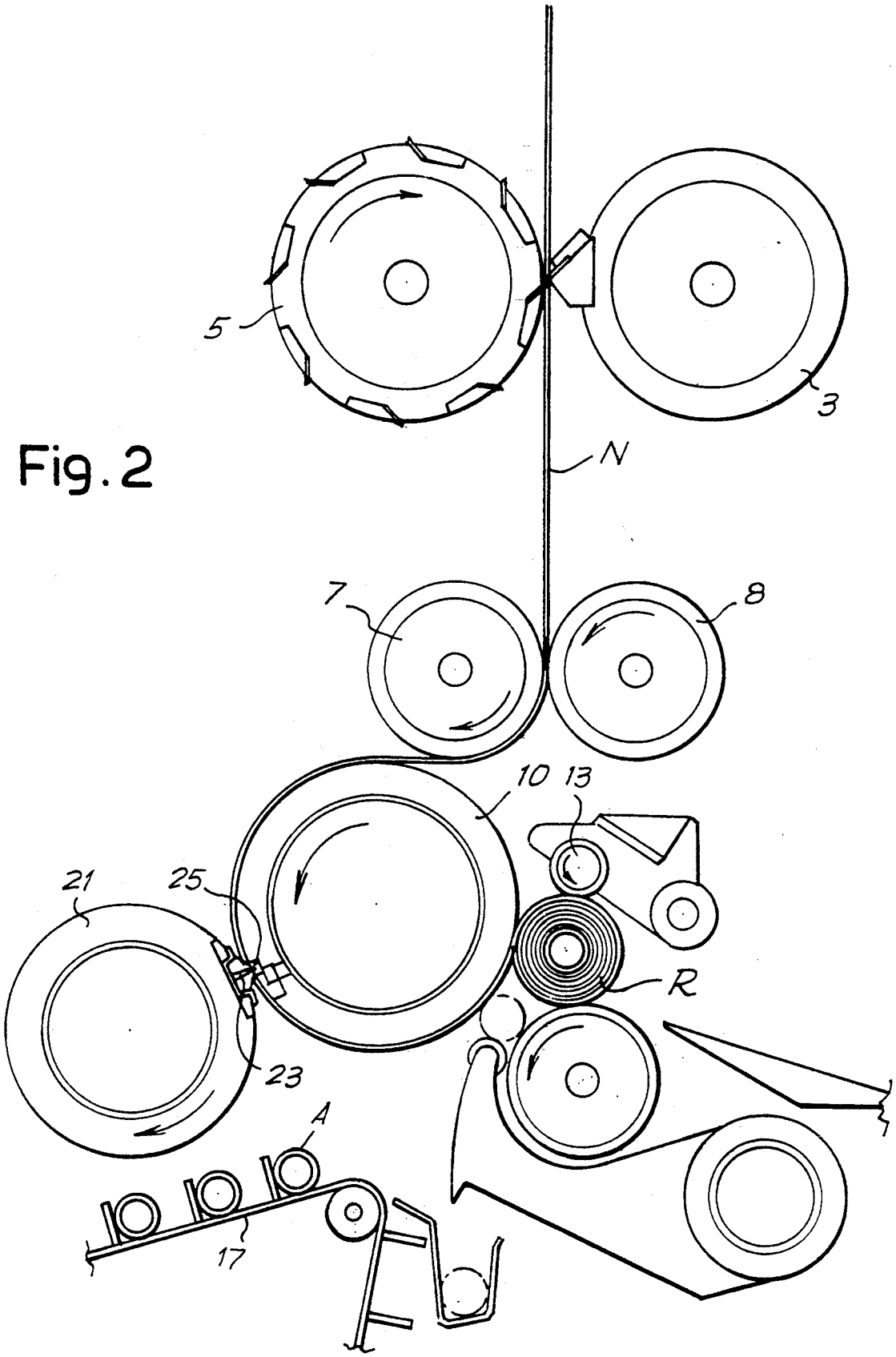
FIG. 2 shows a schematic diagram of the perforator rollers, the drum and the cutting cylinder in a first embodiment.

FIG. 2 shows a detail of the assembly formed by the perforator rollers 3, 5, the drum (which, in this embodiment, is provided with only one recess or counter-blade 25) and of the cutting cylinder 21 with blade 23.

Figure 3:
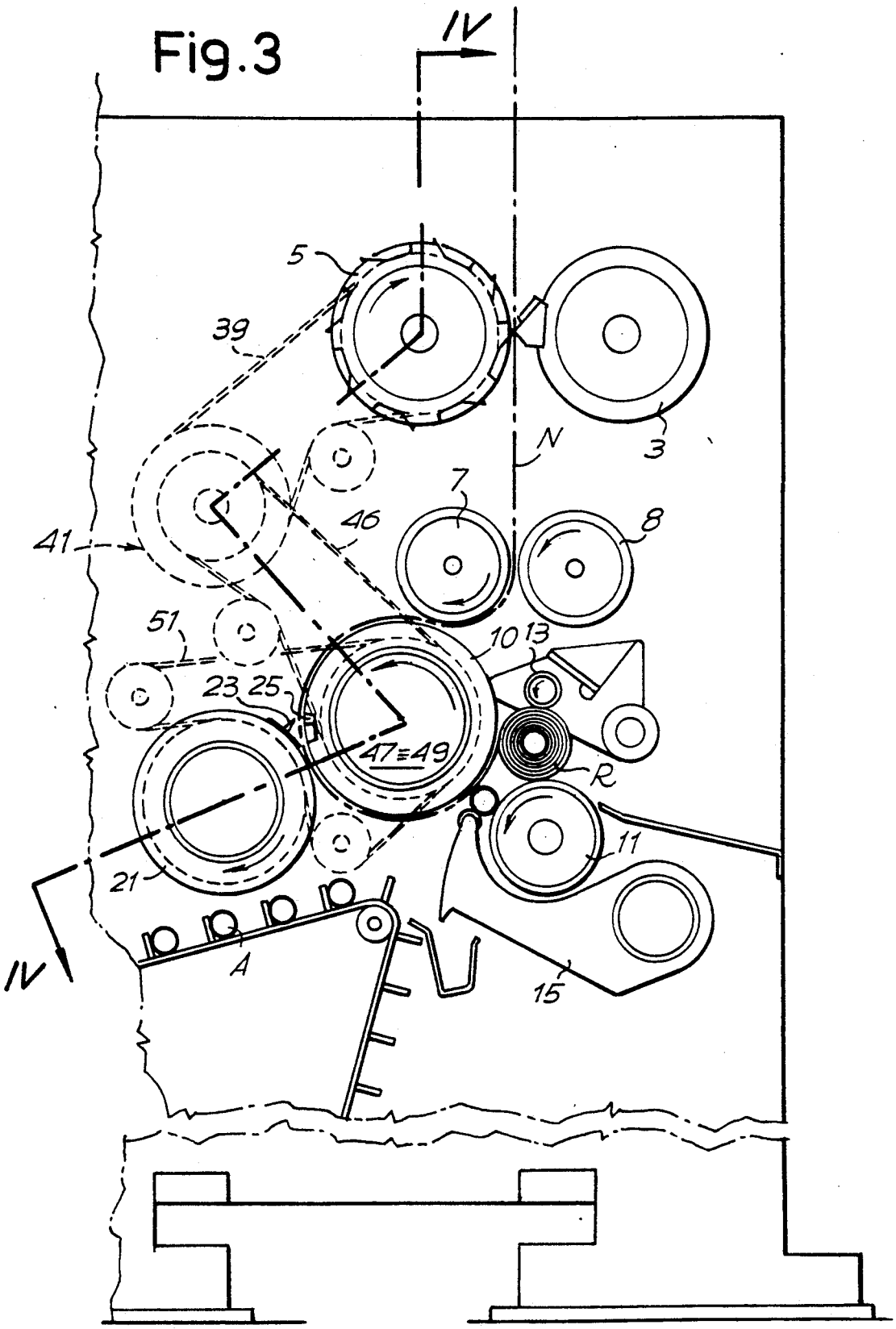
FIG. 3 shows a schematic diagram of the transmissions between perforator rollers, drum and cutting cylinder in the first embodiment.
Figure 4:
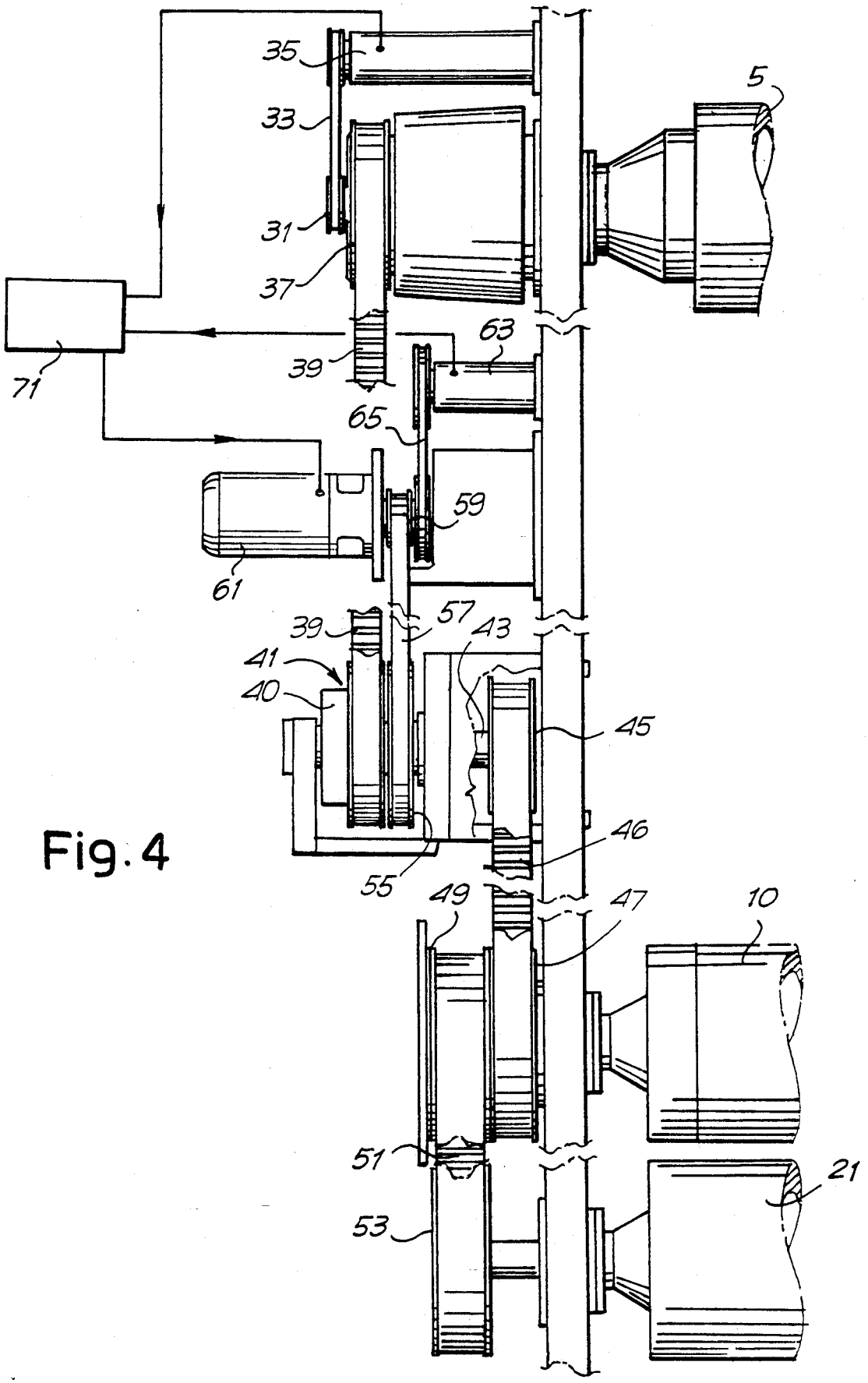
FIG. 4 shows a section taken on the broken line IV—IV of FIG. 3.

FIG. 3 shows a schematic diagram of the transmission or drive-train between the roller 5, the drum 10 and the cutting cylinder 21 in a first embodiment of the invention, while FIG. 4 shows a plan view of the transmission taken along a broken line IV—IV passing through the axles of the rotating members. Keyed on the axle of the perforator roller 5 is a toothed pulley 31 for a first toothed belt 33 which connects the axle of roller 5 to an encoder 35 which detects the rotary speed of the roller 5 and thus the number of perforations carried out by the rollers 3, 5. On the same axle of roller 5, another toothed pulley is keyed for a toothed belt 39 which transmits the motion to the gear casing 40 of a differential generally indicated by 41. Keyed on a first output axle 43 of the differential 41 is a toothed pulley 45 on which a toothed belt 46 is entrained, said toothed belt being further entrained on a further toothed pulley 47 which is keyed on the axle of drum 10. On the same axle of drum 10 is also keyed a further toothed pulley 49 which transmits the motion to a toothed belt 51 which embraces a toothed pulley 53 keyed on the axle of the cutting cylinder 21.

As a consequence, the rotary motions of cutting cylinder 21 and drum 10 are derived from the perforator roller 5, whereby the ratio between the rotational speed of the cutting cylinder and that of the drum 10 is constant and such that the peripheral speed of drum 10 will correspond to the feeding speed of web N.

Keyed on the second axle of the differential 41 is a toothed pulley 55 for a toothed belt 57 driven out onto a further toothed pulley 59 keyed on the axle of a driving motor 61 (also referred to herein as a phase-resetting motor). The number of revolutions or fractions of revolution of the phase-resetting motor 61 is detected by an encoder 63 connected to the phase-resetting motor 61 through a toothed belt 65. by indicating w1 and w2 as the rotational speed of the two output axles of differential 41 and W as the rotational speed of the gear casing of the differential,.the following formula (I) is derived:

$$W = Aw1 + Bw2$$

wherein A and B are real numbers which depend on the internal ratio of the differential. When the axle connected with the phase-resetting motor 61 is at a standstill (i.e., when the phase-resetting motor does not rotate), the ratio between the rotational speed of the perforator roller 5 and the rotational speed of the drum 10 is fixed and of such a selected value as to cause the cut of the web material along a pre-determined perforation line after a pre-set number of revolutions of the drum 10. This is possible because the drum 10 has a circumference equal to a multiple of the distance between two successive perforation lines. The above transmission ratio is pre-set to have a given number of perforations on the log produced by the machine, while the peripheral speed of drum 10 is made equal to the feeding speed of the web material N.

Vice versa, if the phase-resetting motor 61 is caused to rotate the second axle of the differential 41, the speed of the first axle is temporarily changed and there is a temporary movement of the surface of drum 10 along the web material N. this means that the differential 41, along with the phase-resetting motor 61, allows the transmission ratio between the perforator roller 5 and the drum 10, and thus between the perforator roller 5 and the cutting cylinder 21, to be changed. If it is desired to change the number of perforations and thus the length of the web wound on the log in the course of formation, it is sufficient to cause the. relevant axle of the differential. 41 to be rotated a predetermined number of revolutions by the phase-resetting motor 61. This will cause a temporary variation of the rotational speed of drum 10 and thus a temporary slip of the surface of drum 10 along the web N. Since the cutting cylinder 21 is connected to the drum 10 through the toothed belt 51, the change in motion of drum 10 will be transferred to the cutting cylinder 21 so that the blade 23 will, at all times, remain in the correct position to cooperate with the counter-blade 25. The consequence of the intervention of the phase-resetting motor 61 is a slide of the cutting members 23, 25 with respect to the web, thereby allowing said members to be located at a position, with respect to the web, suitable for performing the cutting thereof along any perforation line.

The phase variation must, of course, take place so as not to interfere with the cutting operation, that is to say, the rotation of the phase-resetting motor 61 must be brought to a stop before the cutting of the web takes place. The speed of the phase-resetting motor 61, and thus the speed at which the correction occurs, may be varied according to the feeding speed of the web material N, so as to ensure that the correction is always completed prior to the cutting operation. this may be achieved, for example, by means of the speed signal obtained by the encoder 35 which makes it possible to control, via a central microprocessor unit 71, the speed of the phase-resetting motor 61.

To perform the cutting of the web at the right time, that is to say, after a web length with the desired number, of perforations has been wound on the log in the course of formation, there may be used the same data from the encoder 35 associated with the perforator roller 5. This encoder checks the number of revolutions of the perforator roller 5 and thus the number of perforations which are carried out. The signal generated may be used to control the oscillation of the cutting cylinder 21 against the drum 10. Alternatively, the cutting cylinder 21 may be supported by a foxed axle, while the blade 23 carried by the same cylinder may be made movable so as to be made to project at the right moment for cooperating with the counter-blade 25. Such a solution may use, for example, a device of the type described in Italian patent No. 1, 213, 822 (Application No. 9477 A/87). Also in this case, the movement of the blade may be controlled in response of the signal from the encoder 35.

By controlling the oscillation of the cutting cylinder 21 or the withdrawal of blade 23 and by changing the phase of the drum 10 through the phase-resetting motor 61, it is possible to vary the number of perforations of the web wound on the formed log R, or the length of the wound web, without stopping the machine and without changing or adjusting the mechanical parts thereof.

The encoders 35 and 63 may be connected to a programming means, for example, the microprocessor 71 capable of programming a correction of the phase of drum 10 during ,each cycle, that is to say, for each log R being formed. In this way it is possible to obtain an infinite number of logs, each having a different number of perforations wound thereon.

The above disposition makes it possible also to vary the distance between successive perforations on the same web. In fact, the relative position of the cutting means 23, 25 is pre-set to perform the cutting of the web material after a pre-determined number of perforations and along the last of said perforations. Changing the distance between the perforation lines can be accomplished by changing the phase of drum 10 so that, at the end of a log winding cycle, the cutting will take place again along the pre-set perforation line. This is possible through the phase-resetting motor 61 and the differential 41. When the phase-resetting motor 61 is at a standstill, the machine produces logs of web which are perforated along transverse lines spaced apart a pre-determined distance. Changing the distance between the perforations requires, prior to the cutting of the web, that the position of drum 10 be corrected through the phase-resetting motor 61 in order to bring the cutting means to coincide with the last perforation line.

In practice, the procedure necessary to produce a log with a distance between the perforation lines different from the one being set for the machine, is as follows. The feeding speed of web N being constant, the perforator roller 5 must be driven into rotation at a constant speed other than the standard one (greater or less than the latter, depending whether the desired perforations will have to be more close to, or more spaced from each other, with respect to the standard distance). Since the rotational speed of drum 10 is determined by a kinematic chain which receives the motion from the perforator roller 5, to maintain the peripheral speed of drum 10 generally equal to the feeding speed of the web N, it is necessary to keep the phase-resetting motor 61 into rotation at a generally constant speed. Thus, according to formula (I), even by varying the speed of roller 5 (and thus the rotational speed W of the differential gear casing), the speed of the differential axle which drives the drum 10 will be such as to maintain the peripheral speed of the same drum 10 equal to the feeding speed of web N.

This is possible by a suitable programming of the microprocessor 71 of the machine control unit, which controls the phase-resetting motor 61. On the other hand, the variation of the distance between the perforation lines on the web N implies the need of resetting the position of the winding drum 10 and of the cutting cylinder 21 into phase, so that the cutting of the web will take place correctly always along a line of perforation. This is possible by providing, during a winding cycle, that the phase- resetting motor 61 be temporarily accelerated (or decelerated) to cause a temporary alteration of the rotational speed of drum 10 and thus a resetting of the position of the latter into phase with respect to the web N in transit. It is preferred that the operation for putting drum 10 into phase again be completed prior to the beginning of web N cutting operation, so that, during the cutting, the peripheral speed of drum 10 is again equal to the speed of web N. However, it is also possible to distribute the "phasing" over the whole winding cycle, by providing a peripheral speed of drum 10 which is slightly different than the feeding speed of web N.

It thus follows from the above, that the same disposition allowing the production of logs of web with a continuously variable number of perforations, allows also the production of logs of web with perforations which are variably spaced apart. This is particularly advantageous if it is desired to form, with the same machine and without mechanical adjustments thereof, logs for the production, for example, of small rolls of toilet paper and also logs for the production of all-purpose wiper or other.

Figure 5:
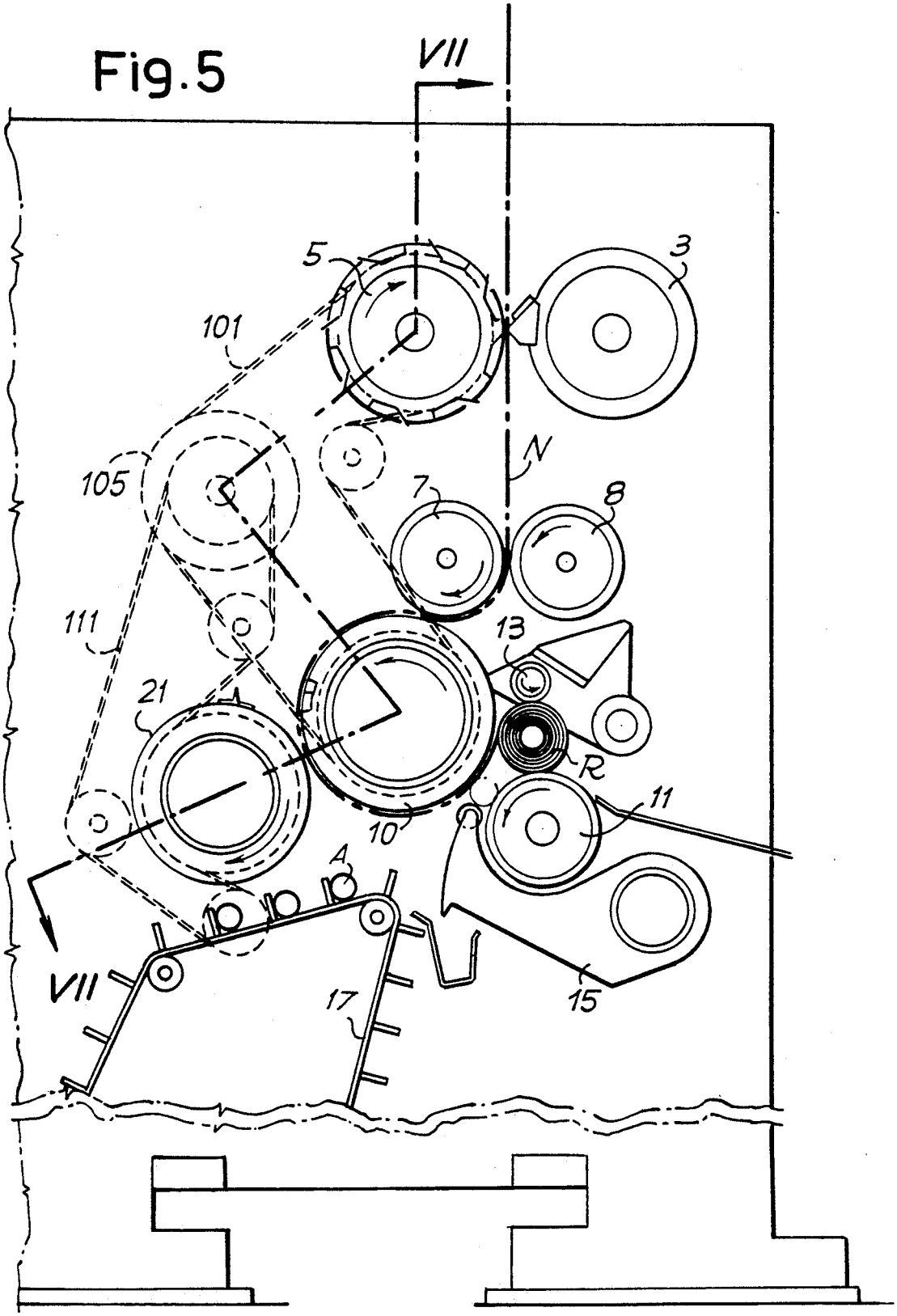
FIG. 5 shows, similarly to FIG. 3, a schematic diagram of the transmissions between perforator rollers, drum and cutting cylinder in a second embodiment.
Figure 6:
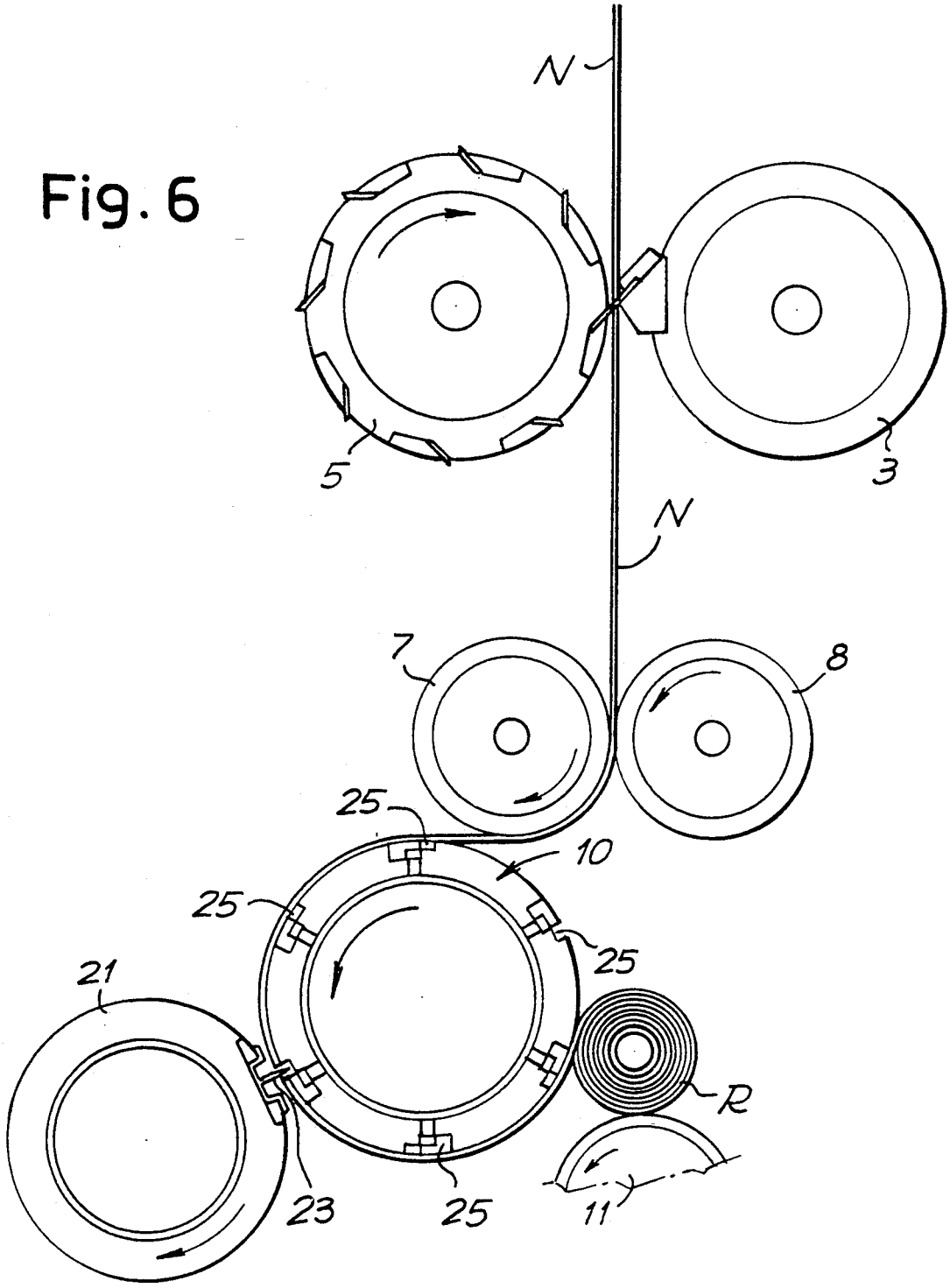
FIG. 6 shows the arrangement of the perforator rollers, the drum and the cutting cylinder of FIG. 5.
Figure 7:
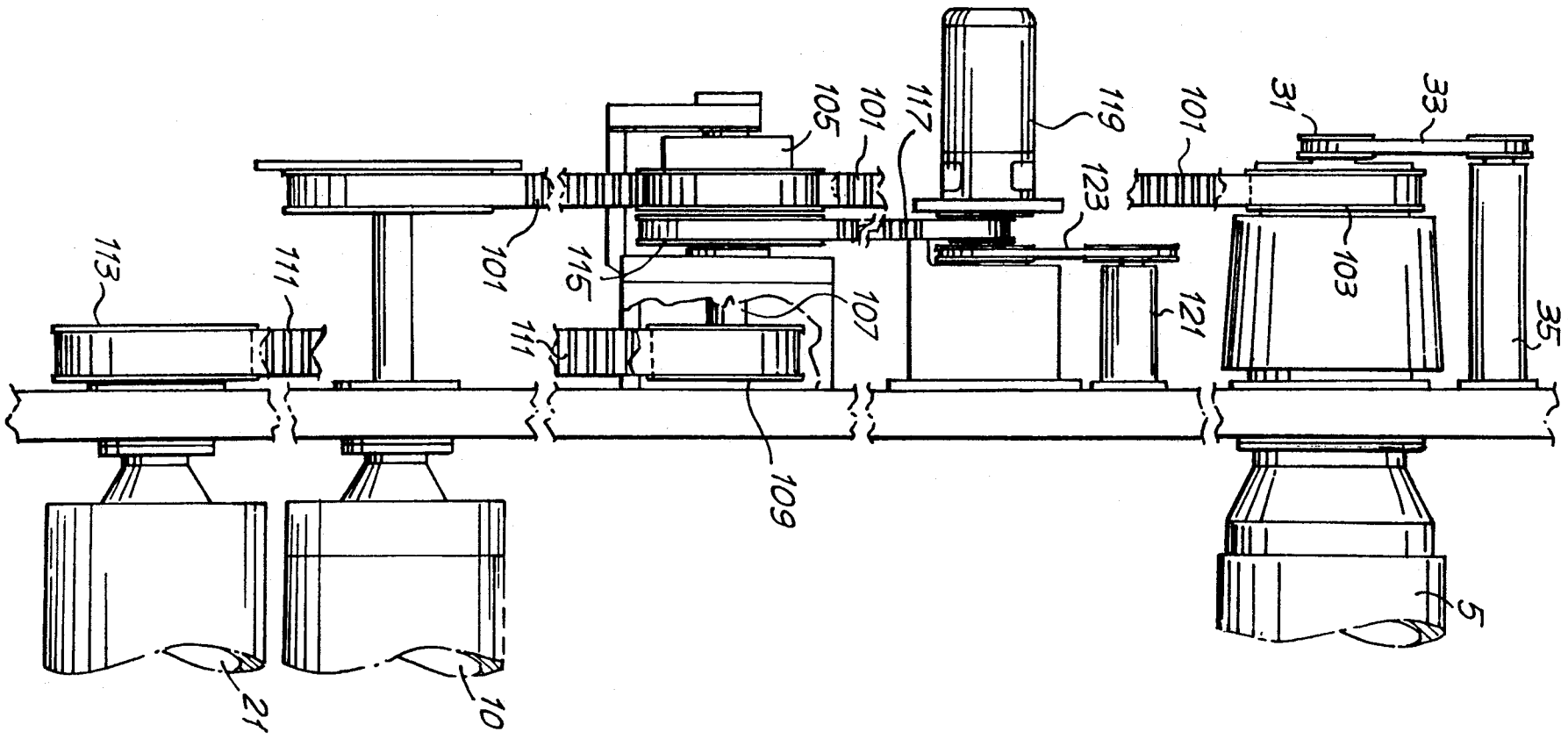
FIG. 7 shows a section taken on broken line VII—VII of FIG. 5.

FIGS. 5, 6 and 7 show a second embodiment of the invention. In this embodiment, the drum 10 is provided with a plurality of equidistant counter-blades or recesses 25, each of which is able to cooperate with the blade 23 carried by the cutting cylinder 21. The distance between adjacent counter-blades or recesses 25 corresponds to the distance provided between perforation lines on web N. In this configuration, a toothed belt 101 is provided which, is entrained on a toothed pulley 103 keyed on the shaft of the perforator roller 5. The toothed belt 101 transmits the motion from the perforator roller 5 to the drum 10 and to the gear casing of a differential 105 corresponding to the differential, 41 of the embodiment of FIG. 4. the rotary speed of the perforator roller 5 is detected by the encoder 35 connected to the axle of said roller via the belt 33 entrained on the toothed pulley 31, as has been described with reference to FIGS. 3 and 4.

Keyed on a first axle 107 of differential 105 is a toothed pulley 109 for a toothed belt 111, which embraces an arc of another toothed pulley 113 keyed on the axle of the cutting cylinder 21. Keyed on the second axle of the differential 105 is a toothed pulley 115 for a toothed belt 117 which receives its motion from a phase-resetting motor 119, the latter being further associated to the encoder 121 which is connected to the phase-resetting motor 119 via a toothed belt 123.

The operation of the apparatus illustrated in FIGS. 5 to 7 is similar to that of FIGS. 2 to 4, save that the phase-resetting motor 119 is intended to modify the phase of the cutting cylinder 21 instead of the phase of drum 10.

If, during the log-winding cycle, the phase-resetting motor 119 is temporarily put into rotation, this will cause the change of phase of the cutting cylinder 21 with respect to drum 10. Consequently, with a predetermined number of revolutions or fractions of revolution of the phase-resetting motor 119 it is possible to modify the phase of the cutting cylinder 21 with respect to the motion of drum 10 in such a way as to bring the blade 23 into cooperation with one or the other of the several recesses or counter-blades 25 on the drum 10. As said recesses or counter-blades 25 are spaced apart an extent corresponding to the (fixed) distance between two adjacent perforations performed by the perforator rollers 3, 5, the phase correction of the cutting cylinder 21 makes it possible to modify, even by one perforation at a time, the number of perforations present in each log.

This configuration does not allow, however, the modification of the distance between the perforations, but has the advantage of not causing a relative slide between the web N. and the surface of drum 10. The oscillation of the cutting cylinder 21 or the extraction of the blade 23 may be operated in a manner similar to the one described with reference to FIGS. 2 to 4.

Figure 8:
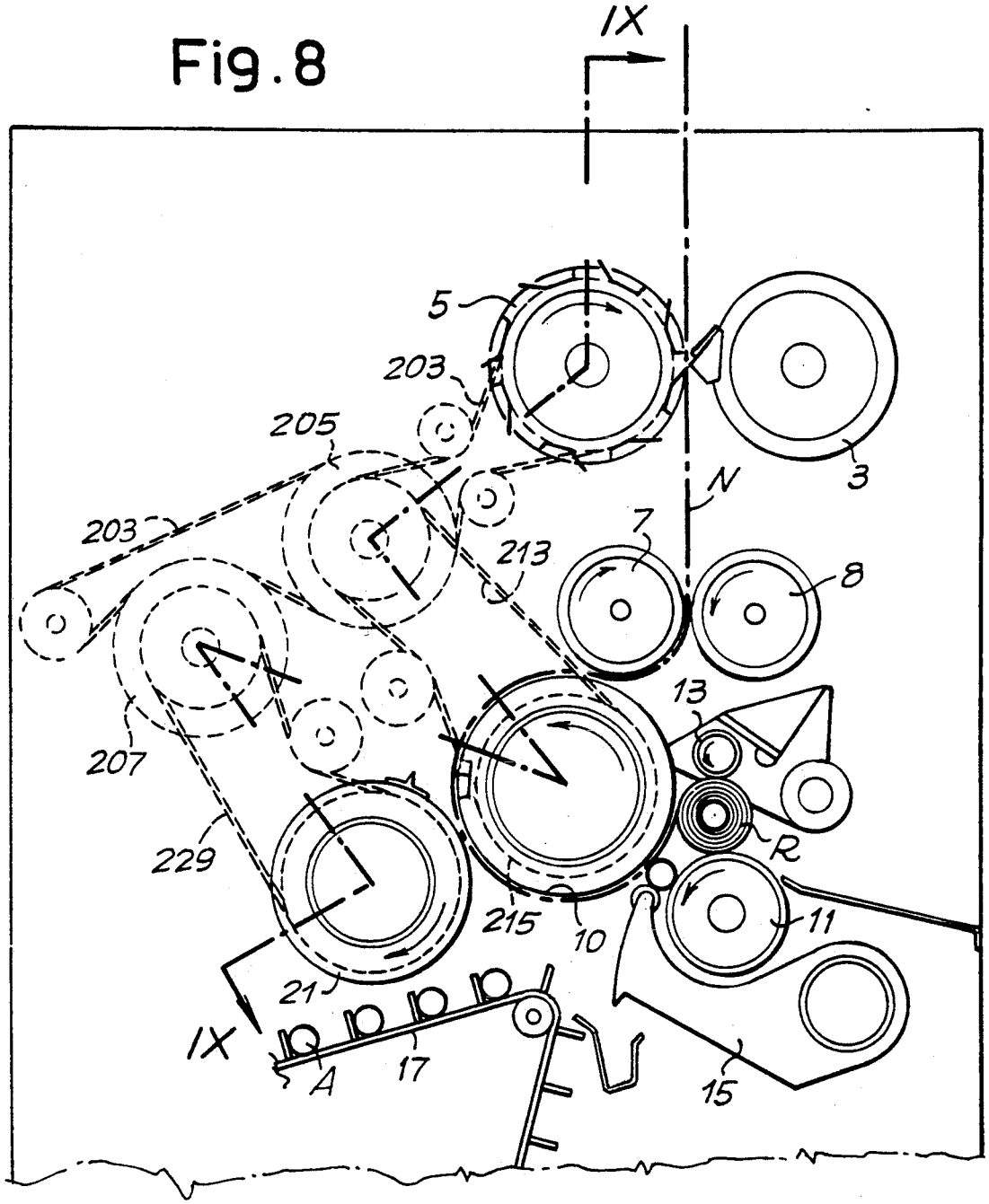
FIG. 8 shows, similarly to FIGS. 3 and 5, a schematic diagram of the transmissions between perforator rollers, drum and cutting cylinder in a third embodiment.
Figure 9:
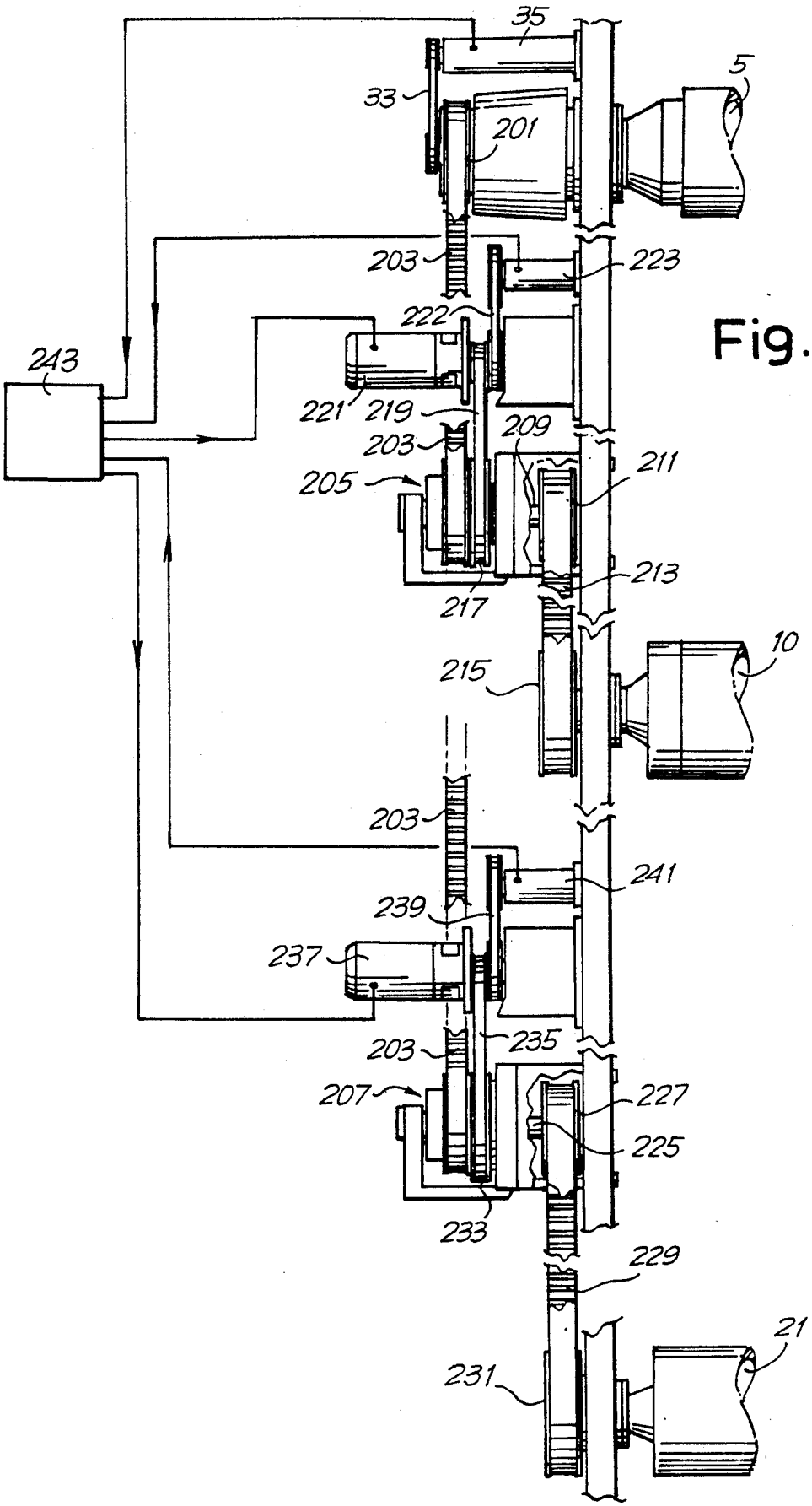
FIG. 9 shows a section taken on broken line IX—IX of FIG. 8.

FIGS. 8 and 9 illustrate a configuration obtained by combining the solutions shown in the..preceding figures. This solution makes it possible to vary both the number of perforations on each log, and the distance between the perforation lines.

On the axle of roller 5, with which the encoder 35 is associated, as in the other above-described configurations, a toothed pulley 201 is keyed for a toothed belt 203 which supplies the motion to the gear casings of two differentials 205 and 207, respectively. The two differentials are thus disposed in parallel. the first differential 205 corresponds to the differential 41 of FIG. 4, while the second differential 207 corresponds to the differential 105 of FIG. 7.

Keyed on the first axle 209 of the differential 205 is a toothed pulley 211 for a toothed belt 213 which transmits the motion to a toothed pulley 215 keyed on the axle of drum 10, while on the second axle of the differential 205 a pulley 217 is keyed drawing the motion from a first phase-resetting motor 221 via a belt 219. To the phase-resetting motor 221, an encoder 223 is connected through a belt 222. This group operates in a similar way as described with reference to the configuration of FIGS. 2 to 4 and is intended to modify the phase of the drum 10, that is to say, to perform a relative slide between the drum and the web being wound.

Keyed on a first axle 225 of the differential 207 is a toothed pulley 227 for a toothed belt 229 which, through a toothed pulley 231, transmits the motion to the cutting cylinder 21. The second axle of the differential 207 carries a toothed pulley 233 for a toothed belt 235, which draws the motion from a second phase-resetting motor 237 connected, via a belt 239, to an encoder 241. The differential 207 has functions corresponding to those of the differential 105 shown in FIG. 7 and is intended to modify the phase of the motion of the cutting cylinder 21 with respect to the motion of the drum 10. By using two differentials it is possible to modify both the motion of drum 10, and the motion of the cutting cylinder 21, and it is possible to act both upon the number of perforations on the web wound over each individual log, and upon the distance between the perforations, with a procedure similar to that already described with reference to the previous solutions. The encoders 35, 223, 241 are connected to a microprocessor 243 or other suitable programming means.

Figure 10:
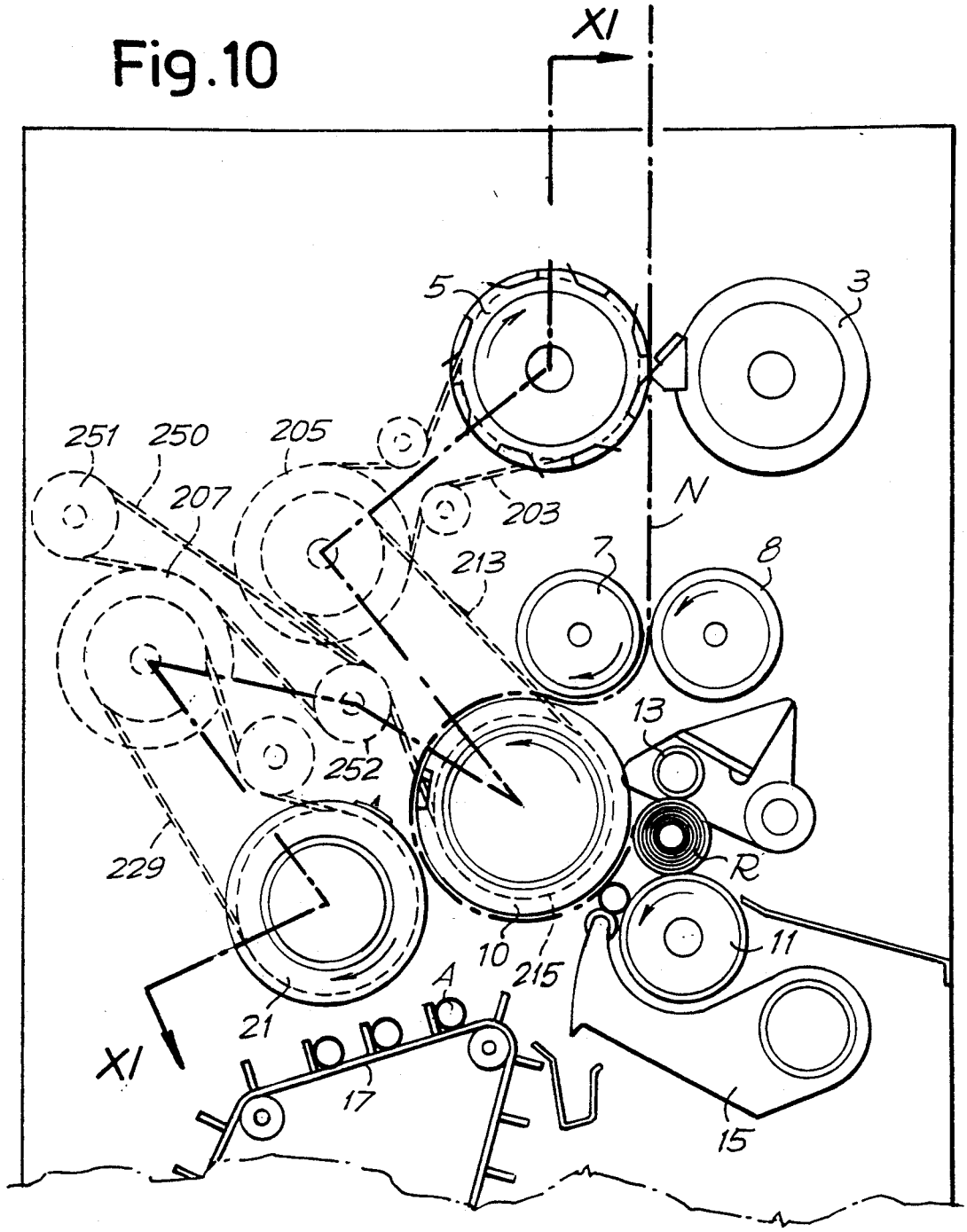
FIG. 10 shows a schematic diagram of the transmissions between perforator rollers, drum and cutting cylinder in a fourth embodiment.
Figure 11:
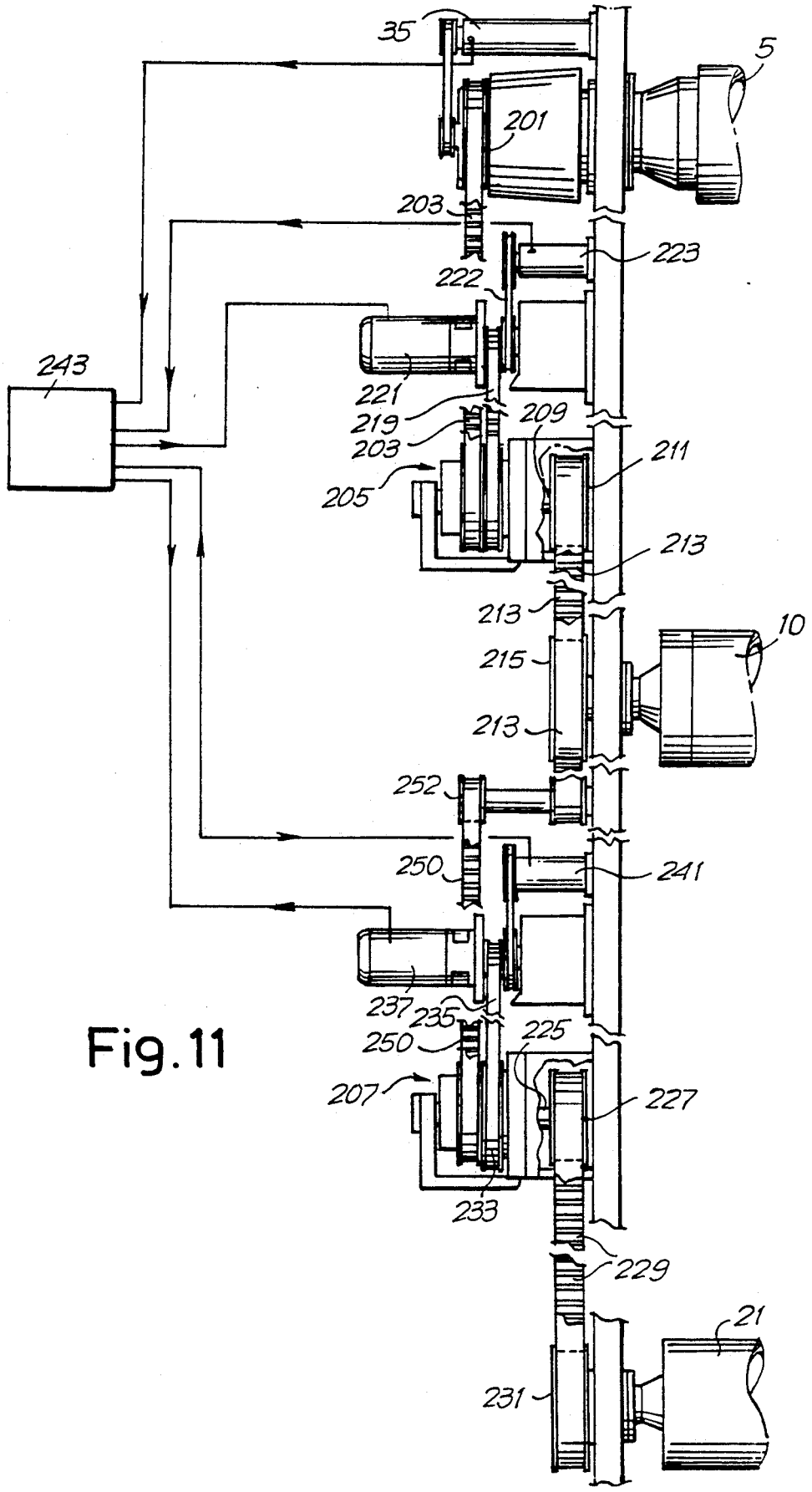
FIG. 11 shows a section taken on broken line XI—XI of FIG. 10.

FIGS. 10 and 11 show an embodiment similar to that illustrated in FIGS. 8 and 9, wherein, however, the two differentials are connected to each other in series instead of in parallel. In these figures, like parts or parts corresponding to those of FIGS. 8 and 9 are designated by the same reference numbers. The only difference from the preceding configuration lies in the fact that the belt 203 provides the motion to the gear casing of the first differential 205 only, whereas the motion to the gear casing of the second differential 207 is supplied by a toothed belt 250 entrained on two toothed pulleys 251, 252 (FIG. 10), the second of which (252) draws the motion from the toothed belt 213 provided for the transmission between the differential 205 and the drum 10. It thus follows that the two differentials 205 and 207 are, in this configuration, disposed in series, thereby a correction imposed on the drum 10 by the phase-resetting motor 221 is automatically reflected also upon the differential 207.

In the solutions of FIGS. 8 to 11, the drum 10 is provided with a plurality of recesses or counter-blades 25, as a phase-displacement between the cutting cylinder 21 and the winding drum 10 is possible.

The last two described solutions (illustrated in FIGS. 8, 9 and 10, 11 respectively ) have a construction more complex than the preceding ones, but allow a high machine flexibility with relatively limited corrections.

Any of the above described configurations makes it possible to modify, by only one perforation, the number of perforations on the web being wound in a log formed by the rewinder. It is evident that the motion to the differential(s) may be supplied, instead of by the perforator roller 5, by any other roller disposed along the path of the web N and whose rotary speed is made to strictly depend on the feeding speed of the web, for example, by one of the driving rollers 7, 8. Accordingly, the above-described apparatuses may be employed also in rewinders having no perforator rollers. In this case, it will be possible to produce logs with any length of wound web.

Figure 12:
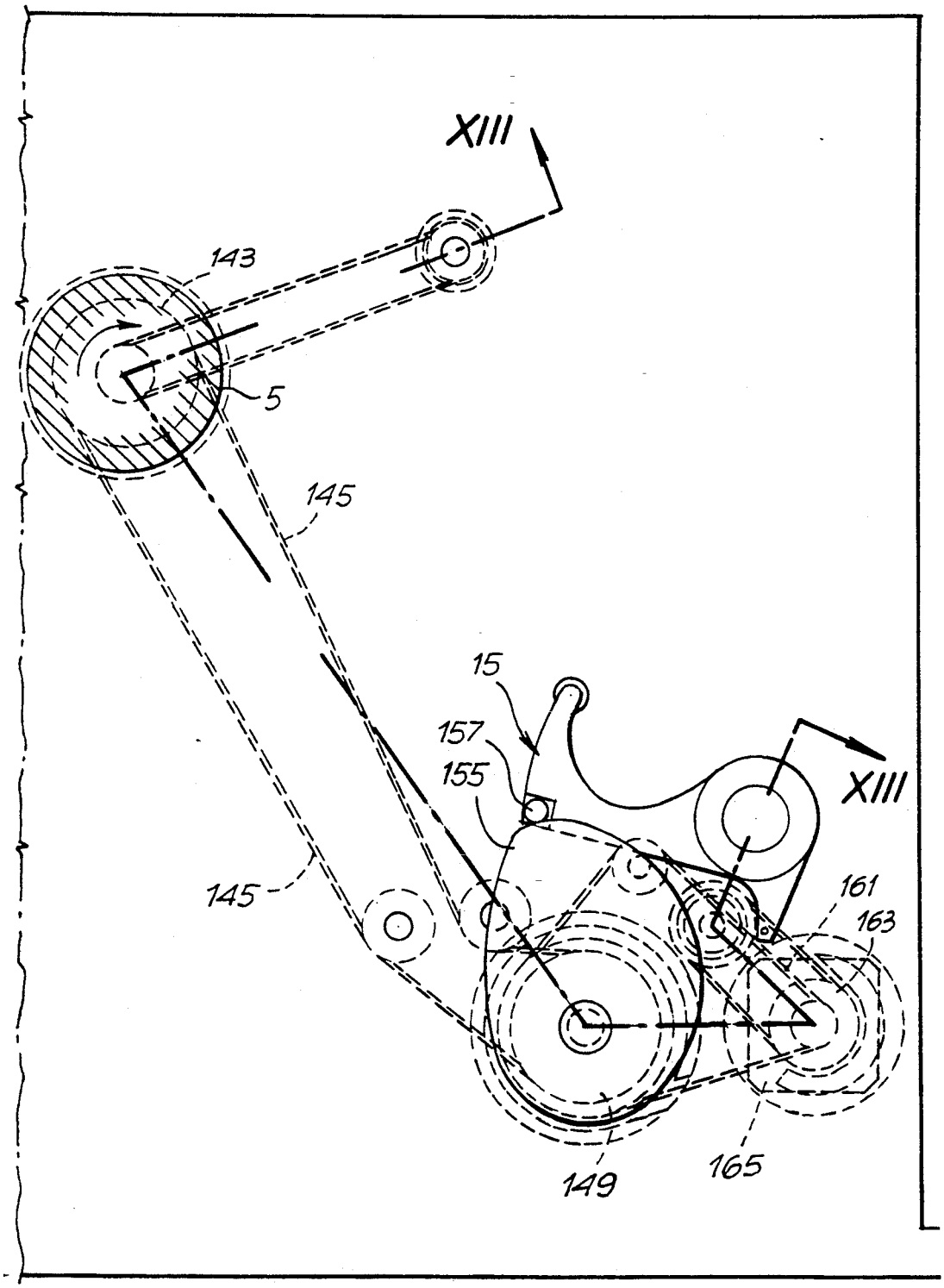
FIGS. 12 and 13 show a schematic diagram of an apparatus for the actuation of the core pusher, FIG. 13 being a section taken along the broken line XIII—XIII of FIG. 12.
Figure 13:
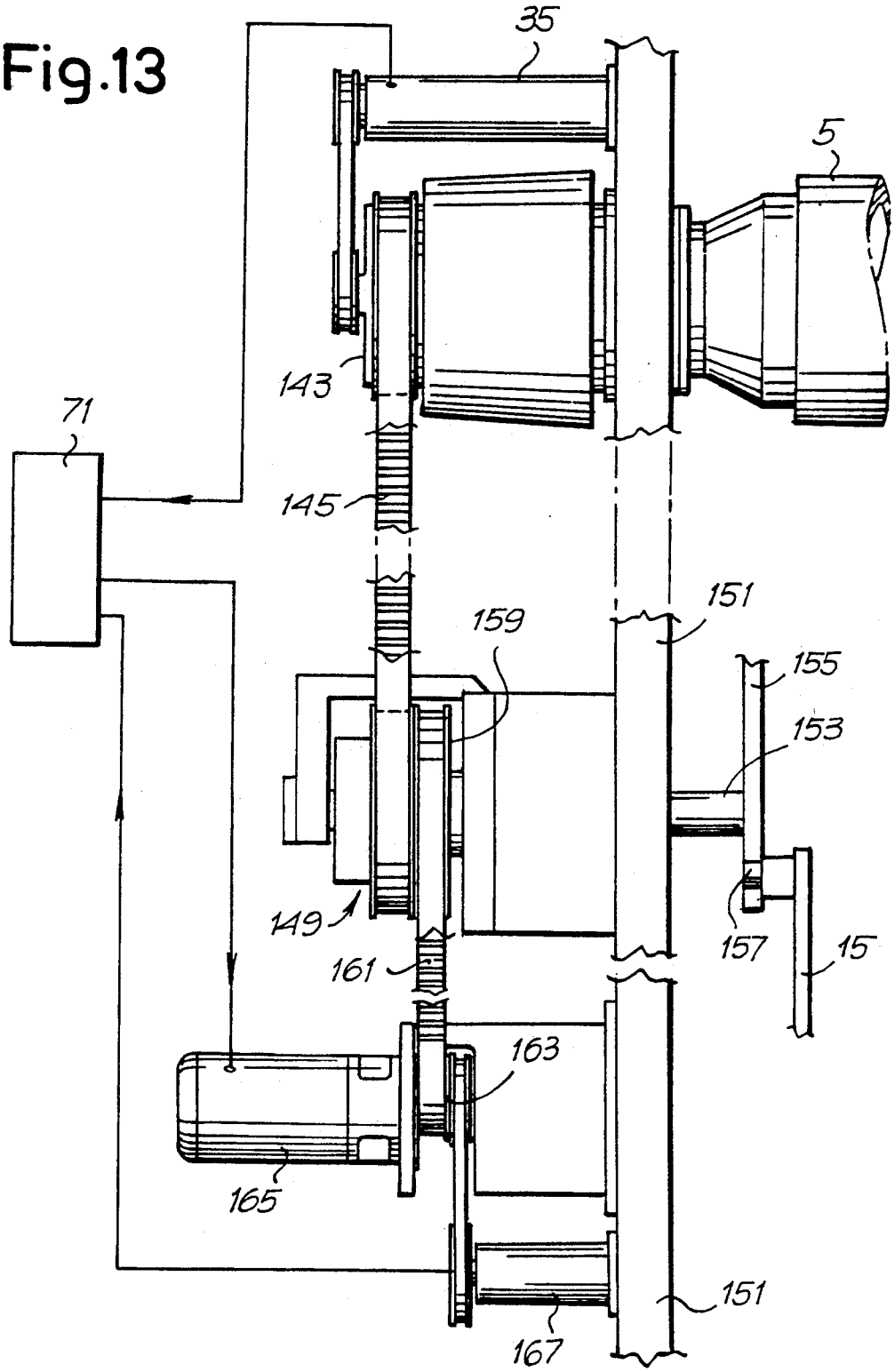

When the number of perforations on the web of each log, that is to say, the length of said web is changed, it is necessary to correspondingly vary the motion of the pusher 15, which must timely insert a new core at the end of the winding of a log. In the traditional machines, the motion of the pusher, like that of the cutting cylinder, is operated by a cam system and is thus rigidly connected to the web feeding motion. In the rewinder according to the present invention, in order to allow an easy variation of web length wound over the log R, the motion of the pusher may be obtained with a differential-operated system similar to those described with reference to the phase-resetting of the drum and/or of the cutting cylinder. An apparatus of this kind is shown in FIGS. 12 and 13.

Driven around a pulley 143 which is fastened to the roller 5 is a toothed belt 145 which supplies the motion to the gear casing of a differential 149 supported by the frame or bearing structure 151 of the rewinder. The gear casing of the differential 149 rotates, thus, at a speed strictly dependent on the rotational speed of the perforator roller 5. Kinematically connected to a first output axle of differential 149, through a reducer (not shown in the drawing) is a shaft 153 bearing a cam 155 which cooperates with a follower 157 carried by the pusher 15 to drive the pusher 15 into oscillation.

Keyed on the second axle of the differential 149 is a pulley 159 on which a belt 161 is entrained, which is further entrained on a pulley 163 being keyed on the output shaft of a motor 165 which is carried by the frame 151. Associated with the motor 165 is an encoder 167 which has the function of detecting the number of revolutions or fractions of a revolution of the motor 165.

The operation of the apparatus is similar to what has been described with reference to the apparatus of FIGS. 3 and 4. The motion of the perforator roller 5 is transmitted, through a suitable transmission ratio, to the cam 155 which drives the pusher 15 into oscillation at a speed suitable for the insertion of a core. If, during a log winding cycle, the motor 165 is driven into rotation, the latter causes a temporary modification of the transmission ratio between the roller 5 and the cam 155, and thus a modification of the frequency of operation of the pusher 15. By a suitable programming, through the microprocessor 71, the motion of the motor 165 may be made to occur in such a way as to put the motion of the pusher 15 in phase with the motion of the drum 10 and/or of the cutting cylinder 21 thereby determining a programmable and selectable correction of web length and/or of the number of perforations on the web being wound on the log R.

For a proper functioning of the apparatus it is necessary that the correction carried out by the motor 165 be completed before the pusher 15 begins to rise, so as to maintain the motion of the said pusher 15 unchanged during the insertion of the core, to this end, it is sufficient that the correction takes place when the follower 157 of the pusher 15 travels the lowest arc of profile of the cam 155. The correction rate may be modified according to the feeding speed of the web material N, for example, by using the speed signal supplied by the encoder 35 to the central unit 71.

The frequency of operation of the pusher 15 may be changed also with other systems. For example, provision may be made for the motor 165 to be kinematically connected to the shaft 153 of cam 155 through a fixed transmission ratio. In this case, the motor drives the oscillation of the pusher 15 directly upon a command from the central microprocessor unit 71. Accordingly, the connection so established with the other movable parts of the machine is merely electrical instead of mechanical. This solution is diagrammatically illustrated in FIG. 13A.

FIG. 13B shows a further solution wherein the pusher 15 is directly driven by a motor 166 in axial alignment with the said pusher. The rotation of motor 166, which may take place, in either direction and at a speed varying with a predetermined program, is controlled by the microprocessor 71 in such a way as to provide the pusher 15 with the motion required for the introduction of the cores.

Alternatively, the movement of the pusher may be operated by a system of the type illustrated in FIG. 14 This figure shows diagrammatically only some members of the rewinder and, in particular, the pusher 15, the lower winding roller 11 on which the log R is made to rest, and a cam 80 keyed on the axle of drum 10 (not shown in FIG. 14). Cooperating with the cam 80 is a follower 82 borne by an arm 84A of a lever 84 pivoted at 86 to the fixed structure 151 of the machine. The second arm 84B of the lever 84 is engaged to a damper 88. The lever 84 is connected to the pusher 15 through a connecting rod 90 pivoted at 92 to the lever 84.

The follower is movable in a direction perpendicular to the plane of the figure, and may take up alternatively a first active position in which it cooperates with the profile of the cam 80, and a second inoperative position in which the follower is withdrawn from the profile of the cam 80. The active position is taken up only during the revolution of the drum 10 (and thus of the cam 80) during which the cutting of the web, and thus the insertion of a new core, takes place the movement of the follower 82 may be operated according to the length of web being fed and/or to the number, of perforations being carried out, both these data being sensed by the encoder 35. The apparatus schematically illustrated in FIG. 14 is described in the Italian patent No. 1,213, 820 (Application No. 9475 A/87), and is incorporated herein by reference.

In this solution, since the cam 80 is keyed directly on the axle of drum 10, the phase-resetting of said drum involves automatically also the phase-resetting of cam 80. However, the cam 80 can be also keyed on an axle which is independent of the axle of the drum 10. In this case, it is necessary to provide for a phase-resetting system with a differential and a phase-resetting motor, of the type similar to the one described with reference to the drum 10, in order to rest the phase of the cam with respect to the position of the winding drum.

To make the machine structure simpler and at the same time more versatile, it is possible to provide a differential device also for actuating the lower winding roller 11 which has to be subjected to a temporary deceleration to allow the discharge of the formed log and the insertion of the next core. At present, these changes in the rotational speed are . achieved by cam systems.

Figure 15:
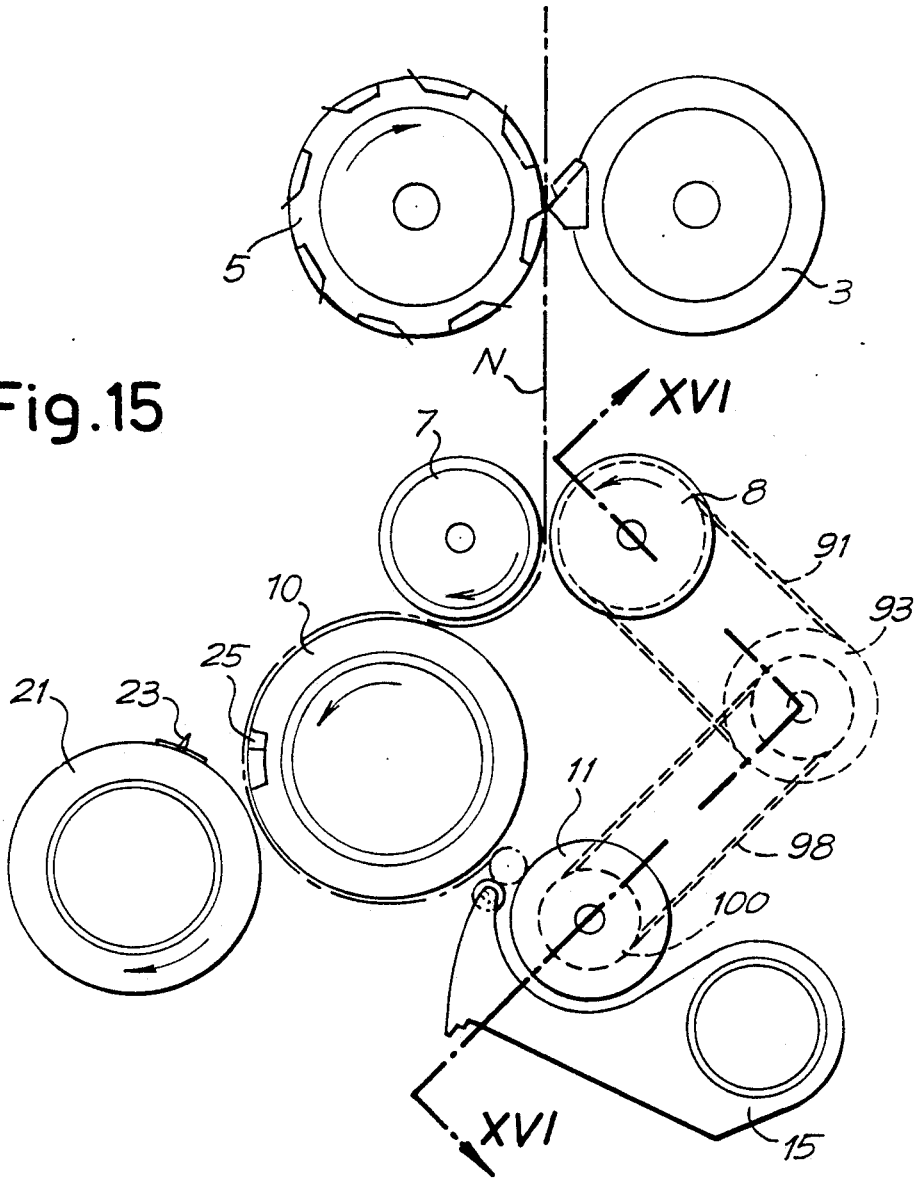
FIGS. 15 and 16 show an apparatus for controlling the speed of the winding roller.
Figure 16:
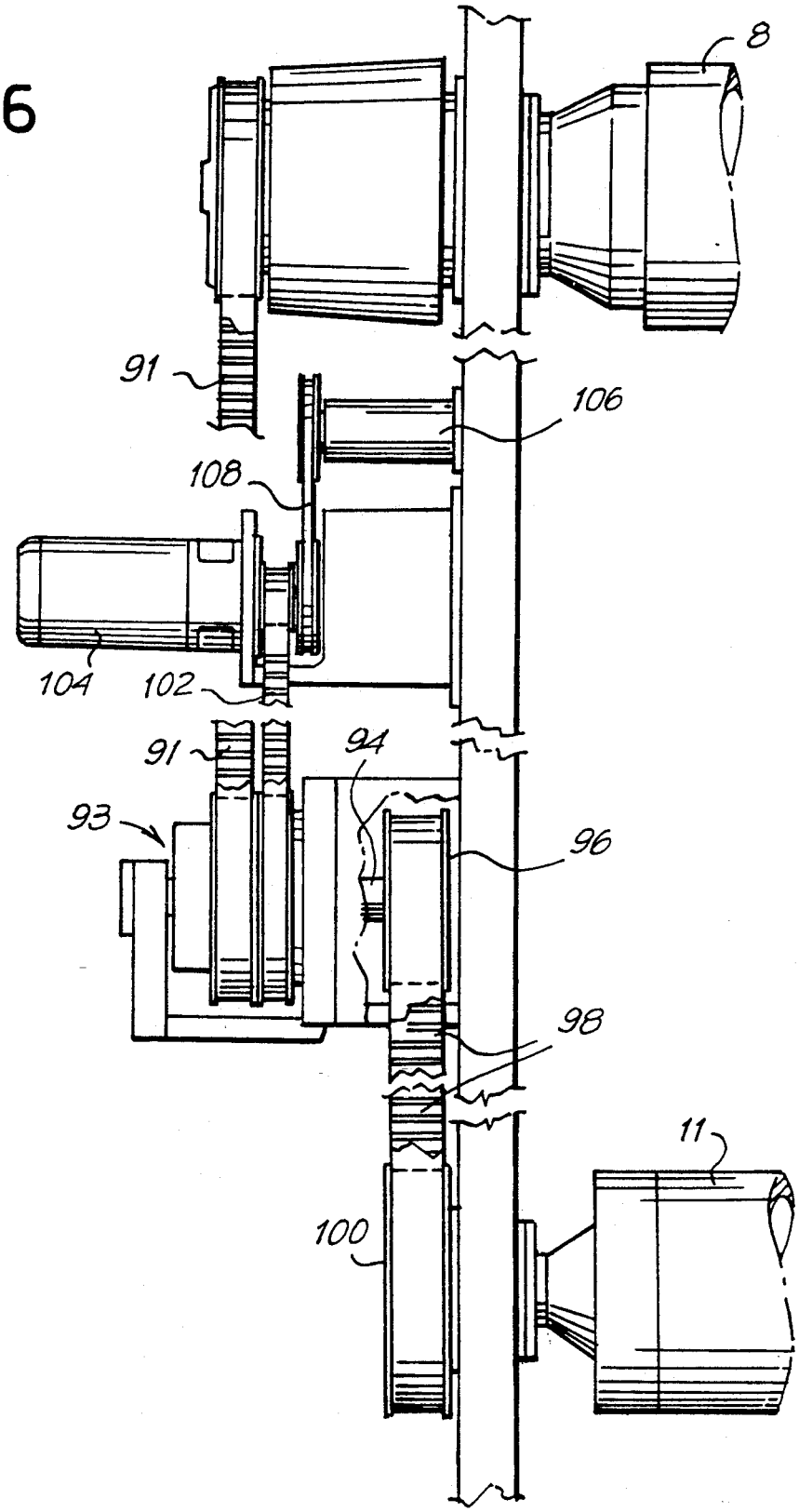

In an improved embodiment of the rewinder according to the present invention, instead, provision is made for having the lower roller 11 associated to a differential system of a type similar to those previously illustrated. Such an apparatus is schematically shown in FIGS. 15 and 16. The motion of the lower winding roller 11 is drawn from the transfer roller 8 via a toothed belt 91. The belt 91 transmits the motion to the gear casing of a differential 93 on one axle 94 of which a toothed pulley 96 is keyed for a further toothed belt 98 entrained on a second pulley 100 keyed on the axle of the lower winding roller 11. The second axle of differential 93 is connected, through a toothed belt 102, to a correction motor 104 whose motion is detected by an encoder 106 connected thereto through the belt 108. The correction motor 104 is driven into rotation at the right moment upon a command from the machine-controlling microprocessor 71, so as to cause firstly a negative and then a positive acceleration of the lower winding roller 11. The signal relevant to the acceleration of roller 11 is detected by the encoder 106 and transmitted by the latter to the central unit 71.

Figure 17:
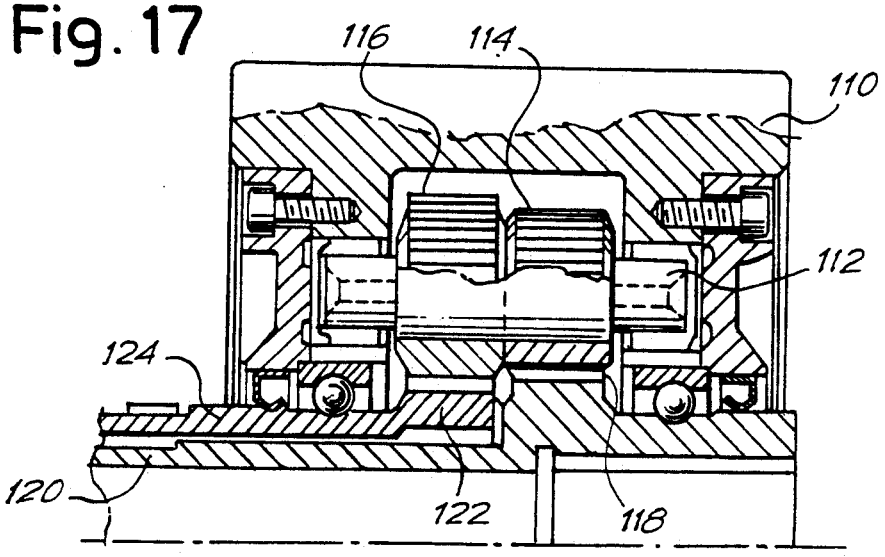
FIG. 17 shows a partial longitudinal section of a differential.

FIG. 17 shows a partial longitudinal section of a differential that can be used in all the above described apparatuses. This well-known differential has a gear casing 110 carrying an axle 112 for a pair of planet wheels 114, 116. The first planet wheel 114 is made to mesh with a planetary gear 118 keyed on a first axle 120, while the second planet wheel 116 meshes with a second planetary gear 122 keyed on the second axle 124. the two axles 120 and 124 are coaxial to each other, the second one being hollow to allow the first to pass therethrough.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what is claimed as new and desired to protect by Letters Patent are the following:

1. A rewinder for producing rolls or logs (R) of web material (N) on a core comprising at least a roller (5, 7, 8) rotating at a speed proportional to the feeding speed of the web material (N), means (10, 11, 13) defining a winding space for the formation of the log (R), pusher means (15) for introducing a core into said winding space, and cutting means (10, 21, 23, 25) for cutting the web material (N) at the end of the winding of each individual log (R), characterized in that it comprises means (41, 61; 105, 119; 205; 221, 207, 237) for automatically varying the phase of the motion of said cutting means (10, 21, 23, 25) with respect to the motion of the web material (N), said means for automatically varying the phase of the motion of the cutting means comprise at least an epicyclic gear train (41; 105; 205; 207) with an input axle kinematically connected to said at least one roller (5; 7; 8) rotating at a speed proportional to the feeding speed of the web material (N), and a second axle kinematically connected to a phase-resetting motor (61; 119; 205; 207), whose rotation determines a temporary variations of the rotational speed of an output axle (43; 107; 209; 225) of said epicycle gear train, said output axle driving the cutting means (10; 21; 23; 25).

2. A rewinder according to claim 1, wherein said epicyclic gear train is a differential, one axle of which is connected to the phase-resetting motor, while the other axle is connected to the cutting means, the gear casing of the differential being kinematically connected to said at least one roller (5; 7; 8) rotating at a speed proportional to the feeding speed of the web material (N).

3. A rewinder according to claim 1, or 2, wherein the output axle of the epicyclic gear train (41; 205) is kinematically connected to a drum (10) for the winding of the web material, said drum carrying at least a counter-blade (25) for the cutting of the web material, which cooperates with a blade (23) carried by a cutting cylinder (21), the motion of the cutting cylinder being synchronized with the motion of the drum (10).

4. A rewinder according to claim 1 or 2, wherein the output axle of the epicyclic gear train (105; 207) is kinematically connected to a cutting cylinder (21) carrying a blade (23) for cutting the web, which cooperates with at least a counter-blade (25) carried by a winding drum (10), the motion of the winding drum being synchronized with the motion of the cutting cylinder.

5. A rewinder according to claim 1 or 2, wherein said means for automatically varying the phase of the cutting means comprise a first epicyclic gear train (205) kinematically connected to a drum (10) for the winding of the web material, and a second epicyclic gear train (207) kinematically connected to a cutting cylinder (10) carrying a blade (23) cooperating with at least one counter-blade (25) carried by said winding drum (10).

6. A rewinder according to claim 1 or 2 wherein said means for automatically varying the phase of the cutting means comprise a first epicyclic gear train (205) kinematically connected to a drum (10) for the winding of the web material, and a second epicyclic gear train (207). kinematically connected to a cutting cylinder (21) carrying a blade (23) cooperating with at least one counter-blade (25) carried by said winding drum (10), and wherein said first and second epicyclic gear trains are connected in series, the motion of the second epicyclic gear train (207) being taken from an output axle of the first epicyclic gear train (205).

7. A rewinder according to claim 1 or 2 wherein said means for automatically varying the phase of the cutting means comprise a first epicyclic gear train (205) kinematically connected to a drum (10) for the winding of the web material, and a second epicyclic gear train (207) kinematically connected to a cutting cylinder (21) carrying a blade (23) cooperating with at least one counter-blade (25) carried by said winding drum (10), and wherein the first and second epicyclic gear trains are disposed in parallel, the input motion to both epicyclic gear trains being derived with fixed transmission ratio from said at least one roller (5; 7; 8) rotating at a speed proportional to the feeding speed of the web material (N).

8. A rewinder according to one or more of claims 1 or 2 or 3, wherein said means for automatically varying the phase of the cutting means comprise a first epicyclic gear train (205) kinematically connected to a drum (10) for the winding of the web material, and a second epicyclic gear train (207) kinematically connected to a cutting cylinder 910) carrying a blade (23) cooperating with at least one counter-blade 925) carried by said winding drum (10), and comprising a pair of perforator rollers (3, 5) for carrying out a plurality of transverse perforation lines on the web material (N), and wherein the input motion to the means for automatically varying the phase of the motion of the cutting means with respect to the feeding motion of the web material (N) is derived from one (5) of said perforator rollers.

9. A rewinder according to one or more of claims 1 or 2, wherein said means for automatically varying the phase of the cutting means comprise a first epicyclic gear train 9205) kinematically connected to a drum (10) for the winding of the web material, and a second epicyclic gear train (207) kinematically connected to a cutting cylinder (21) carrying a blade (23) cooperating with at least one counter-blade (25) carried by said winding drum (10), and comprising a winding drum (10)

and a cutting cylinder (21), said cutting cylinder (21) and said winding drum (10) carrying blade-like cutting means; wherein the cutting cylinder is provided with an oscillatory motion to move close to the winding drum (10) and to perform the cutting of the web material; and wherein the oscillatory motion is controlled depending on a signal generated by the amount of web material being wound on the log (R) in the course of formation.

10. A rewinder according to one of claims 1 or 2, wherein said means for automatically varying the phase of the cutting means comprise a first epicyclic gear train (205) kinematically connected to a drum (10) for the winding of the web material, and a second epicyclic gear train 9207) kinematically connected to a cutting cylinder (21) carrying a blade (23) cooperating with at least one counter-blade (25) carried by said winding drum (10), and wherein the pusher means (15) for the insertion of cores into the winding space is operated by an output axle (153) of an epicyclic gear train (149), whose input motion is derived from said at least one roller (5; 7; 8) rotating at a speed proportional to the feeding speed of the web material (N), to which gear train (149) a correction motor (165) is associated, which is connected to one of the axles of the epicyclic gear train (149) for temporarily varying the speed of the outlet axle of said epicyclic gear train.

11. A rewinder according to one of claims 1 or 2, and wherein said pusher means (15) is provided with oscillatory motion controlled by a cam (155) kinematically connected to the output axle 9153) of said epicyclic gear train (149).

12. A rewinder according to one of claims 1 or 2, and wherein the pusher means (15) for inserting the cores into the winding space is actuated by a shaft whose rotation is operated by a motor (165; 166) being controlled depending on a signal which depends on the amount of wound web material.

13. A rewinder according to any one of claims 1 or 2 wherein the pusher means (15) for inserting the cores into the winding space is actuated by a shaft whose rotation is operated by a motor (165; 166) being controlled depending on a signal which depends on the amount of wound web material, and wherein the motor (166) which operates the pusher means (15) is connected to an axle (153) on which a cam (155) is keyed for driving the pusher means (15) into oscillation.

14. A rewinder according to any one of claims 1 or 2, wherein the pusher means (15) for inserting the cores into the winding space is actuated by a shaft whose rotation is operated by a motor (165; 166) being controlled depending on a signal which depends on the amount of wound web material, and wherein the motor (166) which operates the pusher means (15) is directly connected to the axle of the same pusher means.

15. A rewinder according to any one of claims 1 1 or 2 wherein the pusher means (15) for inserting the cores into the winding space is actuated by a shaft whose rotation is operated by a motor (165; 166) being controlled depending on a signal which depends on the amount of wound web material, and wherein the pusher means (15) for the insertion of the cores into the winding space is controlled by a cam (80) cooperating with a follower (82) able to move away from the cam profile between one insertion operation .and the subsequent insertion operation and wherein the rotation of the cam (80) is synchronized with the rotation of the winding drum (10).

16. A rewinder according to one of claims 1 or 2 wherein the winding space of the log (R) is delimited on the bottom by a lower winding roller (11) rotating at a controlled and variable speed to perform the discharging of log (R) upon completion of the winding thereof and to control the advancement of the core, and wherein the rotary speed of said lower winding roller (11) is controlled by an epicyclic gear train (93) and by a correction motor (104) connected to one of the axles of said epicyclic gear train (93).

17. A rewinder for producing rolls or logs (R) of web material wound on a core (A), comprising: at least a roller (5; 7; 8) rotating at a speed proportional to the feeding speed of the web material; a winding drum (10); a cutting cylinder (21) cooperating with said winding cylinder (10) to carry out the cutting of the web material (N), the winding drum (10) and cutting cylinder (21) carrying means for cutting the web material (N); a lower winding roller (11) delimiting, along with the winding drum (10), a winding space for the formation of the log (R), said lower winding roller being operated in a controllable manner so as to slow down and control the discharge of the finished log (R) and the advancement of a newly inserted core (A); a pusher (15) for introducing a core (A) into said winding space and combined with means (149, 165) for modifying the frequency of operation of said pusher; means (41; 61; 105, 119; 205; 221, 207, 237) for automatically varying the phase of the motion of said cutting means (10, 21, 23, 25) with respect to the motion of the web material; sensor means (63; 121; 223, 241) for detecting the degree of phase variation of the cutting means with respect to the advancement of the web material (N); sensor means (167) for detecting the degree of correction of the frequency of operation of the pusher means (15); and a control unit (71; 243) for programming and controlling the degree of phase variations of the cutting means, the correction of the frequency of operation of the pusher means with respect to the advancement of web (N), and the system for controlling the slowing down of the lower winding roller.

18. A rewinder, according to claim 17, wherein at the roller (5; 7; 8) is associated with a speed sensor connected to the control unit (71; 243), the phase variations of said cutting means and the correction of the frequency of operation of the pusher means taking place at a speed controlled in response to the feeding speed of the web material.

* * * * *